US008661601B2

(12) United States Patent
Klingbeil

(10) Patent No.: US 8,661,601 B2
(45) Date of Patent: Mar. 4, 2014

(54) DEVICE FOR REMOVING STICKERS OR THE LIKE FROM PETS, A PERSON'S CLOTHING, GEAR OR EQUIPMENT

(76) Inventor: Michael H. Klingbeil, Papillion, NE (US)

( * ) Notice: Subject to any disclaimer, the term of this patent is extended or adjusted under 35 U.S.C. 154(b) by 23 days.

(21) Appl. No.: 13/399,450

(22) Filed: Feb. 17, 2012

(65) Prior Publication Data

US 2012/0260447 A1 Oct. 18, 2012

Related U.S. Application Data

(60) Provisional application No. 61/517,145, filed on Apr. 14, 2011.

(51) Int. Cl.
*A47L 13/18* (2006.01)
*A47L 25/00* (2006.01)

(52) U.S. Cl.
USPC ..... 15/227; 15/105

(58) Field of Classification Search
USPC ..... 15/227, 105
See application file for complete search history.

(56) References Cited

U.S. PATENT DOCUMENTS

2006/0242780 A1* 11/2006 Yang et al. ..... 15/227
2007/0061986 A1* 3/2007 Huntington ..... 15/227
2007/0086828 A1* 4/2007 Stewart ..... 401/7
2008/0078046 A1* 4/2008 Reed ..... 15/227
2009/0307858 A1* 12/2009 Gionet ..... 15/104.93

* cited by examiner

*Primary Examiner* — Randall Chin
(74) *Attorney, Agent, or Firm* — Dennis L. Thomte; Thomte Patent Law Office LLC

(57) ABSTRACT

A device is described for removing stickers such as cockleburs, burrs, foxtails, etc. from pets, a person's clothing, gear or equipment. The tool is mitten-shaped with an open end into which the person may insert the person's hand. Two embodiments of the device are disclosed. In the first embodiment, both sides of the device have loop-type fastening material thereon. In the second embodiment, only one side of the device has the loop-type fastening material thereon for removing stickers or the like. A protective liner is positioned at the inner surface of the device.

8 Claims, 5 Drawing Sheets

DEVICE FOR REMOVING STICKERS OR THE LIKE FROM PETS, A PERSON'S CLOTHING, GEAR OR EQUIPMENT

CROSS-REFERENCE TO RELATED APPLICATION

This application claims the benefit of Provisional Application Ser. No. 61/517,145, filed on Apr. 14, 2011, entitled A DEVICE FOR REMOVING STICKERS OR THE LIKE FROM PETS, A PERSON'S CLOTHING, GEAR OR EQUIPMENT.

BACKGROUND OF THE INVENTION

1. Field of the Invention

This invention relates to a device for removing stickers such as cockleburs, foxtails, etc. from a person's clothing. Even more particularly, this invention relates to a mitten-like glove for removing stickers from a person or a person's clothing. Further, this invention may be used to remove stickers or the like from pets, gear or equipment.

2. Description of the Related Art

A person working, hunting or playing outdoors frequently encounters stickers such as cockleburs, burrs, foxtails, etc., resulting in those stickers adhering to the clothing of the person. Such stickers are difficult to remove from the person's clothing and many different devices and methods have been previously employed in an attempt to remove the stickers therefrom. The stickers are also difficult to remove from pets, gear or equipment.

Some people have used knives or credit cards to scrape the stickers from their clothing. Others have used duct tape, lint remover rollers, etc. All of the prior art devices and methods have been less than successful.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In one embodiment, a mitten-like device is provided for removing stickers such as cockleburs, burrs, foxtail or the like from a person's clothing. The device may also be used to remove stickers from pets, gear or equipment. The device comprises first and second panel members having inner and outer surfaces, first and second ends, and first and second sides. The first and second panel members may be of a single sheet of material or may be comprised of two separate sheets of material joined together at the sides and one end thereof. The panel members are comprised of a loop-type VELCRO® fastener material so that the loops thereof are positioned at the outer surface thereof. Preferably, a Nylon or KEVLAR® liner is positioned within the device to prevent the person's hand from injury should a sticker penetrate the VELCRO® material. The device may be rolled upon itself and secured in that position by a VELCRO® strap. In use, a person inserts the person's hand into the open end of the device and rubs the exterior surfaces of the panel members over the stickers with the stickers adhering to the loops of the VELCRO® material.

In a second embodiment, the first panel portion or panel member is comprised of the loop-type portion of a VELCRO® fastening system with the loops thereof being at the outer surface of the first panel portion. The second panel portion is comprised of a material such as Nylon, polyethylene or other suitable material. The second panel portion has a strip of the loop-type portion of a VELCRO® fastening system adjacent the closed end of the mitten. A protective liner is provided at the inner side of at least the first panel portion. One end of a flexible strap is secured to the first panel portion at the closed end of the mitten and has first and second sides. The first side of the flexible strap has a strip of the hook-type portion of a VELCRO® fastening system secured thereto at the other end of the flexible strap for selective engagement with the loop-type portion strip on the second panel portion. The flexible strap has a compartment formed therein which is open at one side thereof to permit a card to be inserted thereinto and which may be removed therefrom to be used as a scraping tool to remove the burrs or the like from the outer surface of the first panel portion.

The second embodiment may be rolled or folded and secured in that rolled or folded position by the flexible strap in the same manner as in the first embodiment.

It is therefore a principal object of the invention to provide an improved device for removing stickers such as cockleburs, burrs, foxtails or the like from a person's clothing.

A further object of the invention is to provide a device of the type described which has a protective inner layer or liner.

A further object of the invention is to provide a device of the mitten-type which may be rolled upon itself or folded upon itself for storage or transport.

A further object of the invention is to permit a device for removing stickers or the like from pets, gear or equipment.

A further object of the invention is to provide a device of the type described which is easy to use and is economical of manufacture, refined in appearance and durable in use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
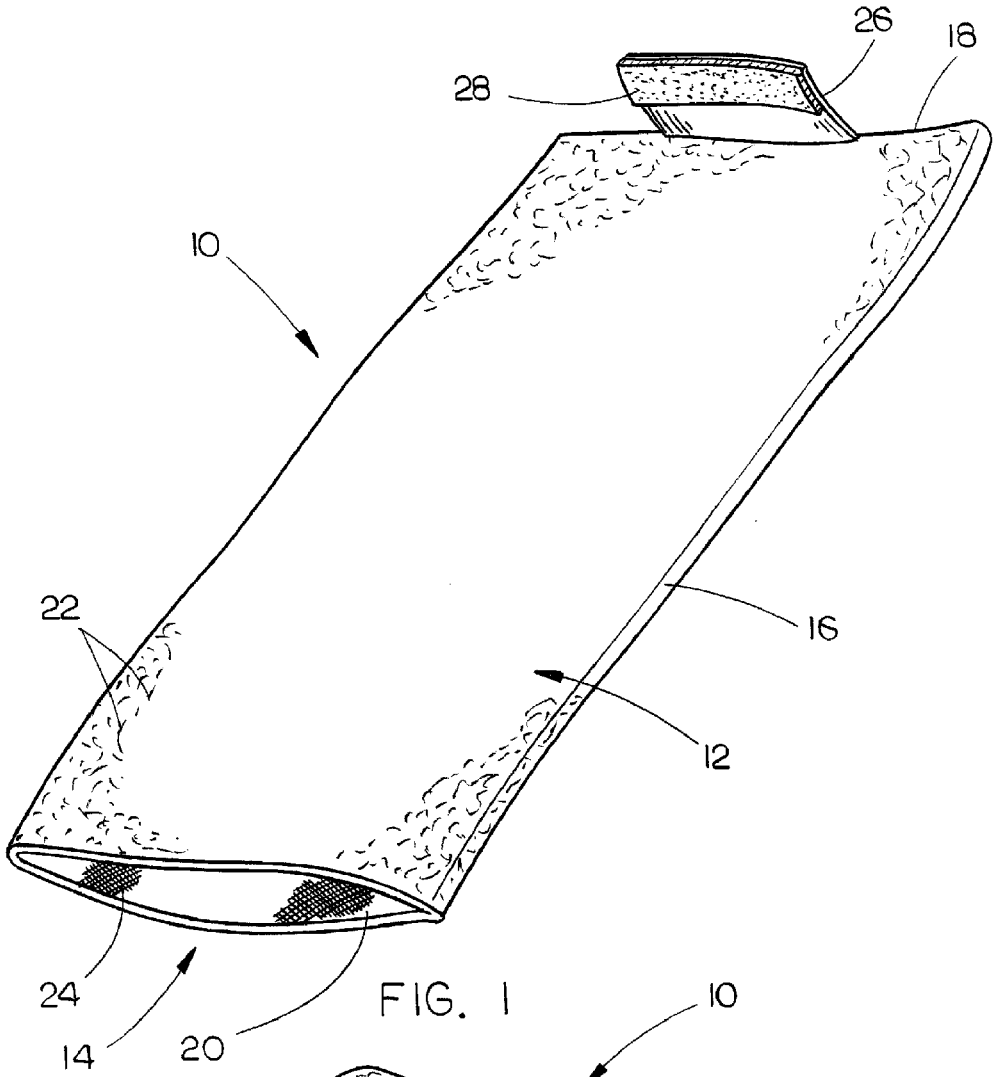
FIG. 1 is a perspective view of the device of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

In one embodiment, the device of this invention is referred to by the reference numeral 10. Device 10 is shown to be in mitten-like form but could be in glove form as well. Device 10 includes a first panel portion 12 and a second panel portion 14. Panel portions 12 and 14 may be of one-piece construction folded upon itself and stitched together at side edge 16 and end 18 or could be comprised of separate panel portions joined together by stitching at both side edges thereof and at end 18.

As seen, device 10 has an open end 20. Panel portions 12 and 14 are constructed of the loop portion of a VELCRO® fastener system with the loops 22 being at the outer surface of the glove. Preferably, a liner 24 is positioned within the device and is secured to the panel portions 12 and 14. Liner 24 is designed to protect a person's hand should a sticker penetrate the outer layer of the VELCRO®. Liner 24 is preferably constructed of a Nylon or KEVLAR® material.

Figure 2:
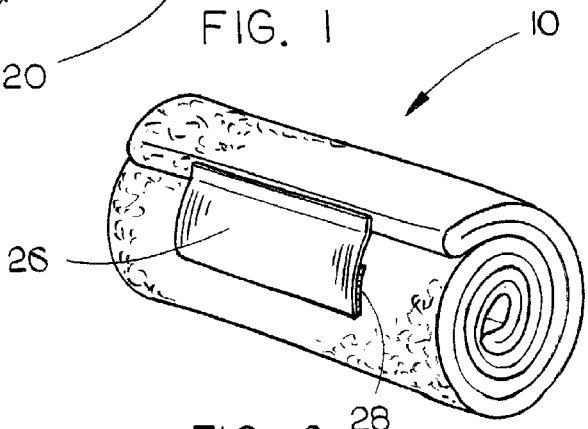
FIG. 2 is a perspective view of the device of this invention in a rolled-up condition.

A flexible strap 26 is secured to end 18 by stitching or the like and has a strip 28 of the hook portion of a VELCRO® fastening system secured thereto. Device 10 may be rolled upon itself with the strap 26 being utilized to maintain the device in the rolled-up condition of FIG. 2.

Figure 3:
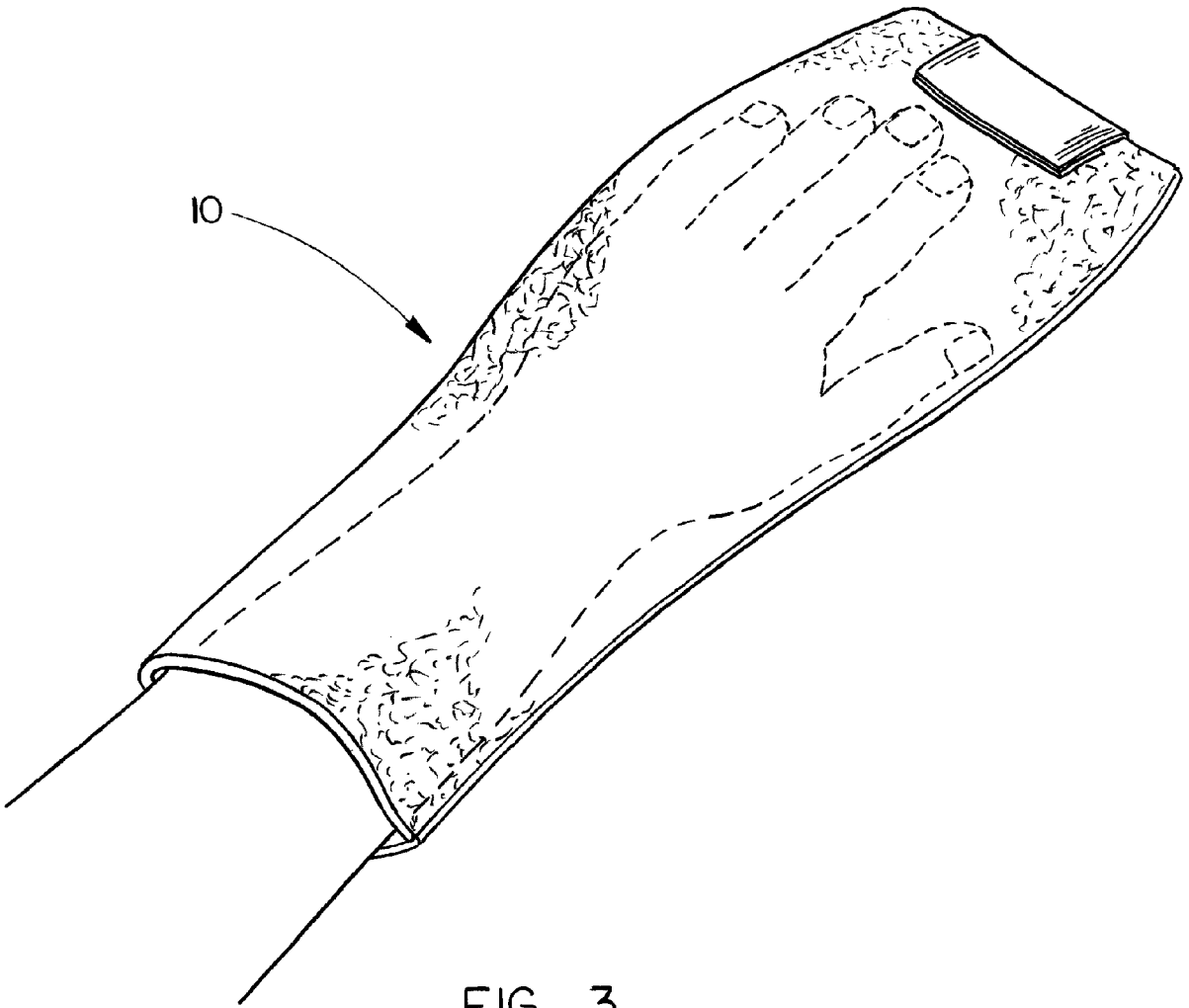
FIG. 3 is a perspective view illustrating a person's hand in the device of this invention.
Figure 4:
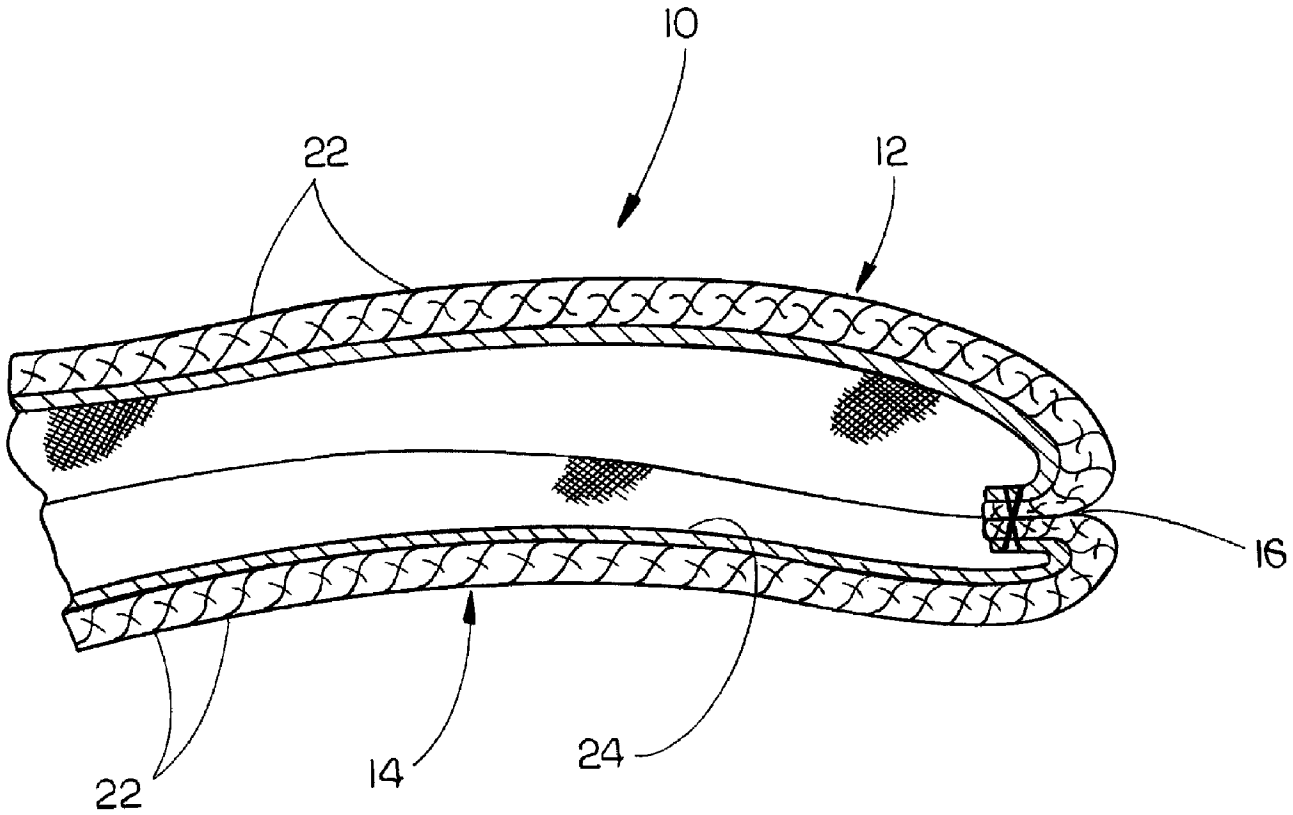
FIG. 4 is a partial sectional view of the device of this invention.

When it is desired to remove stickers from a person's clothing, the person inserts one hand into the interior of the device as seen in FIG. 3. The person then rubs the device over the stickers with the stickers adhering to the loops of the device so that the stickers are removed from the person's clothing.

The device of FIGS. 1-4 may also be used to remove stickers from pets, gear or equipment.

Figure 5:
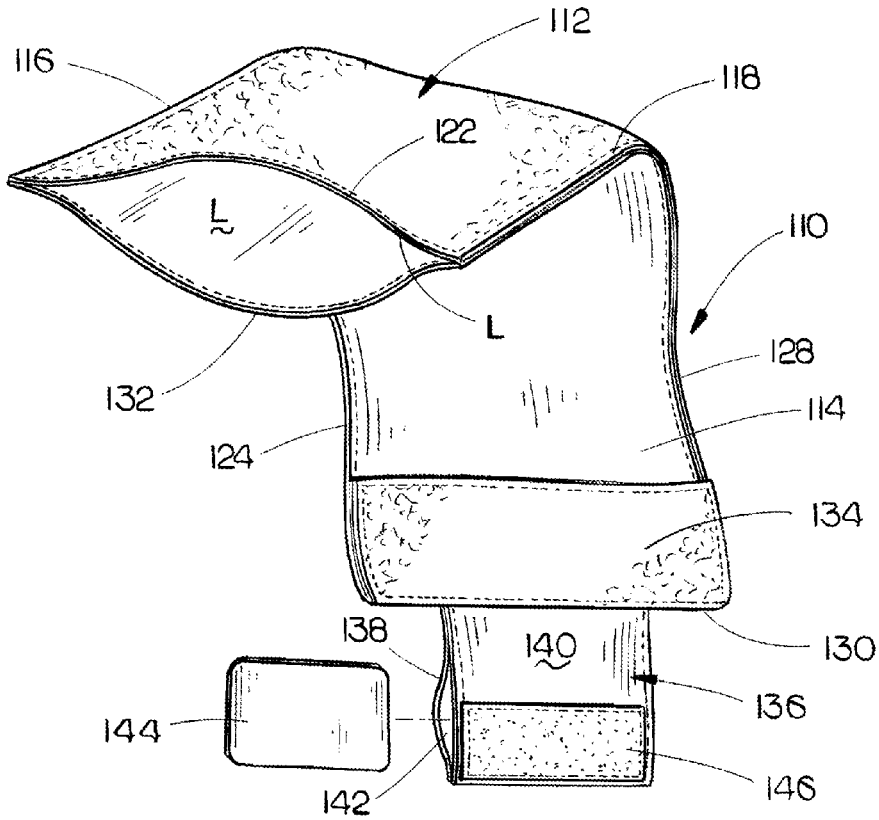
FIG. 5 is an exploded perspective view of a second embodiment of the invention.
Figure 6:
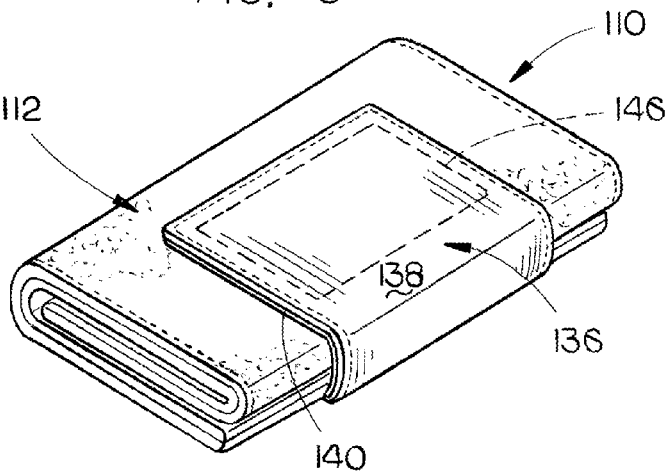
FIG. 6 is a perspective view of the second embodiment in a folded position.
Figure 7:
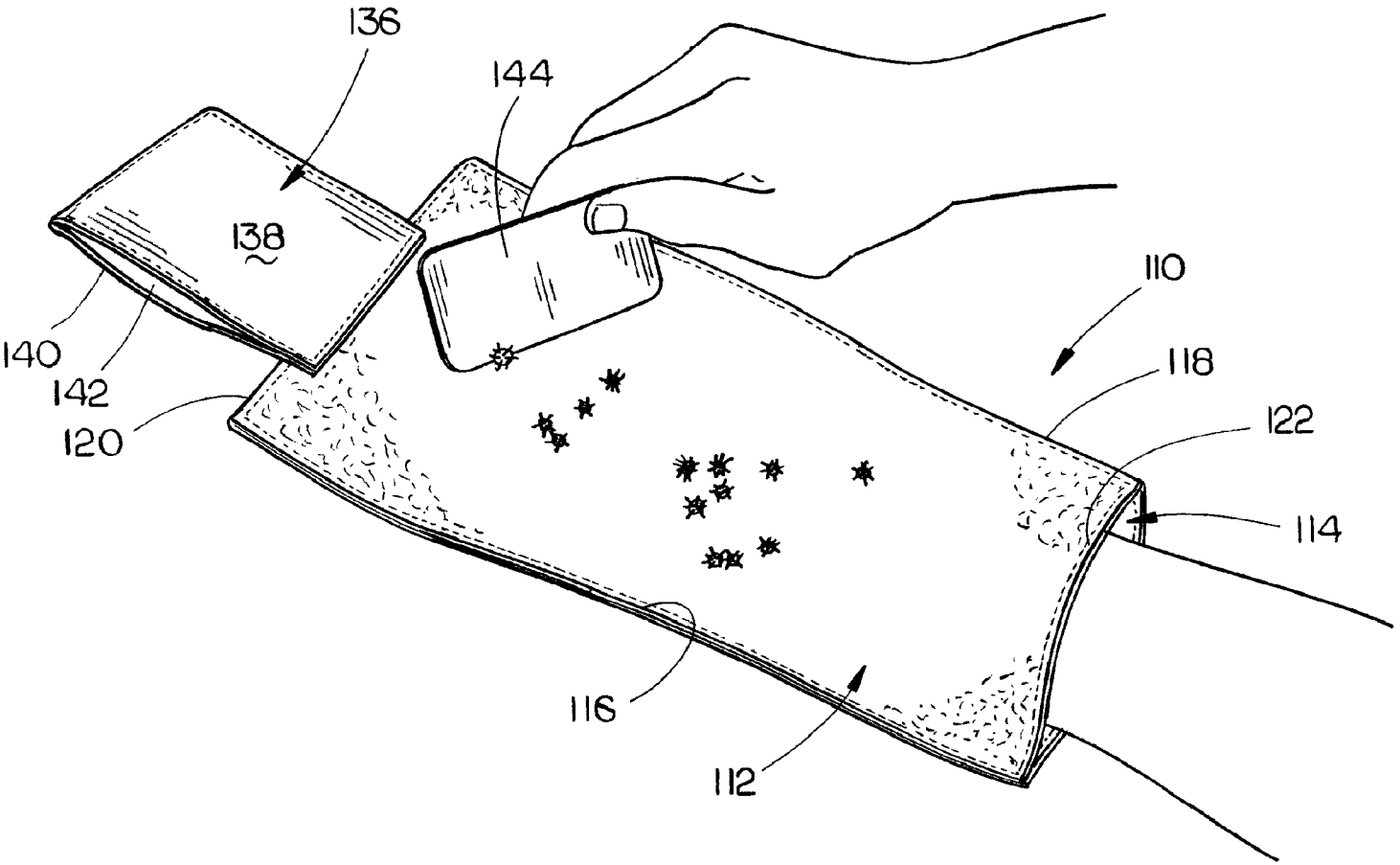
FIG. 7 is a perspective view of the second embodiment illustrating a scraping card being used to remove stickers from the device.

The second embodiment of this invention is illustrated in FIGS. 5-7 and is designated by the reference numeral 110. Device 110 is shown to be in mitten-like form which could be in glove-type form as well. Device 110 includes a first panel portion 112 and a second panel portion 114. Panel portion 112 includes a first side edge 116, a second side edge 118, end 120, end 122, and inner and outer surfaces. The outer surface of panel portion 112 is comprised of the loop-type portion of a hook and loop fastener system such as VELCRO®. Panel portion 114 includes a first side edge 124, a second side edge 128, end 130 and end 132 as well as inner and outer surfaces. The outer surface of panel portion 114 is devoid of any of the loop-type fastening members except for a strip of loop-type fastening material 134 which is secured to the outer surface of panel portion 114 at end 130 thereof.

Side edges 116 and 124 of panel portions 112 and 114 are stitched together as are side edges 118 and 128 of panel portions 112 and 114 respectively. Ends 120 and 130 of panel portions 112 and 114 are also stitched together so that the ends 122 and 132 are open to permit a person to insert his/her hand therein. Preferably, the inner sides of panel portions 112 and 114 have liners similar to the liners of device 10.

The numeral 136 refers to a flexible strap having one end thereof secured to panel portion 112 at end 120. Strap 136 is comprised of two strap portions 138 and 140. One end of strap 136 is stitched to panel portion 112 at end 120 and extends therefrom, as seen in FIG. 7. The strap portions 138 and 140 are stitched so as to provide a card compartment 142 therebetween which is accessible from one side thereof and which is adapted to receive a scraping card 144 therein. Preferably, the side of the strap 136 which enables the scraping card 144 to be inserted between the strap portions 138 and 140 is selectively removably closed by a VELCRO® closure system. A strip of hook-type fastening material 146 is secured to panel portion 140 as seen in FIG. 5.

When the device 110 is being used to remove stickers from panel portion 112, the strap 136 is folded over so that the strip 146 is engaged with the strip 134. The person inserts his/her hand into the device 110 to remove stickers from pets, a person's clothing, gear or equipment. When it is desired to remove the stickers from the loop-type fastening material on panel portion 112, the user may remove the card 144 from the compartment 142 and scrape the card 144 over the outer surface of panel portion 112 to scrape the stickers therefrom.

When the device 110 is not being used, the device 110 may be folded upon itself as seen in FIG. 6 with the strap 136 being used to maintain the device 110 in the folded position of FIG. 6.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A mitten-like device for removing stickers or the like from pets, a person's clothing, gear or equipment, comprising:

a first generally rectangular flexible panel having a first end, a second end, a first side edge, a second side edge, an inner surface and an outer surface;

a second generally rectangular flexible panel having a first end, a second end, a first side edge, a second side edge, an inner surface and an outer surface;

said first ends of said first and second panels being joined together;

said first side edges of said first and second panels being joined together;

said second side edges of said first and second panels being joined together;

said second ends of said first and second panels defining an opening whereby a person may insert the person's hand into the mitten-like device;

said outer surface of said first panel being comprised of a loop-type fastening material;

said outer surface of said second panel having a strip of loop-type fastening material secured thereto at said first end thereof;

a flexible strap having a first end, a second end, a first side edge, a second side edge, an inner side and an outer side;

said first end of said flexible strap being secured to said first end of said first panel;

and a strip of hook-type fastening material secured to said outer side of said flexible strap at said second end thereof;

said strip of hook-type fastening material being selectively releasably secured to said strip of loop-type fastening material at said outer surface of second panel when the mitten-like device is being used to remove stickers or the like from pets, a person's clothing, gear or equipment;

said strip of hook-like material being selectively releasably secured to said loop-type fastening material on said outer surface of said second panel when the device is rolled or folded upon itself to maintain the device in the rolled or folded position.

2. The mitten-like device of claim 1 further including a liner material positioned adjacent said inner surfaces of said first and second panels.

3. The mitten-like device of claim 1 wherein said liner material is comprised of Nylon.

4. The mitten-like device of claim 1 wherein said liner material is comprised of a synthetic fiber material.

5. The mitten-like device of claim 1 wherein said liner material is comprised of a polyethylene material.

6. The mitten-like device of claim 1 wherein said flexible strap has a card compartment formed therein adapted to selectively removably receive a scraping card therein.

7. The mitten-like device of claim 6 wherein said card compartment is accessible from one of said side edges thereof.

8. The mitten-like device of claim 1 further including a liner material positioned adjacent said inner surface of said first panel.

* * * * *